US008658033B2

(12) United States Patent
Farkas

(10) Patent No.: US 8,658,033 B2
(45) Date of Patent: Feb. 25, 2014

(54) METHOD AND SYSTEM FOR INSTALLING A DRAIN

(76) Inventor: Dennis Farkas, Aiken, SC (US)

( * ) Notice: Subject to any disclaimer, the term of this patent is extended or adjusted under 35 U.S.C. 154(b) by 0 days.

(21) Appl. No.: 13/806,058

(22) PCT Filed: Jun. 19, 2011

(86) PCT No.: PCT/US2011/041014

§ 371 (c)(1),
(2), (4) Date: Dec. 20, 2012

(87) PCT Pub. No.: WO2011/163096

PCT Pub. Date: Dec. 29, 2011

(65) Prior Publication Data

US 2013/0098472 A1 Apr. 25, 2013

Related U.S. Application Data

(60) Provisional application No. 61/356,773, filed on Jun. 21, 2010.

(51) Int. Cl.
*E03F 5/06* (2006.01)
*E03F 5/14* (2006.01)
*E03F 9/00* (2006.01)

(52) U.S. Cl.
USPC ..... 210/164; 210/163; 210/541; 4/679; 4/695; 285/42; 285/56; 52/302.3; 52/302.7

(58) Field of Classification Search
USPC ..... 52/302.7, 302.3, 302.1, 741.1; 285/42, 285/56, 58; 210/163, 164, 541; 4/613, 695, 4/679, 288; 137/362
See application file for complete search history.

(56) References Cited

U.S. PATENT DOCUMENTS

| | | | | | |
|---|---|---|---|---|---|
| 1,792,345 | A | * | 2/1931 | Williams | 210/164 |
| 2,190,532 | A | * | 2/1940 | Lukomski | 210/164 |
| 3,713,539 | A | * | 1/1973 | Thompson et al. | 210/164 |
| 4,883,590 | A | * | 11/1989 | Papp | 210/164 |
| 4,984,309 | A | | 1/1991 | Lowry | |

(Continued)

FOREIGN PATENT DOCUMENTS

KR 1020080042327 A 5/2008

OTHER PUBLICATIONS

Shin Seok Hyo, Internatrional Search Report and Written Opinion, Feb. 17, 2012, ISA/KR, Republic of Korea.

*Primary Examiner* — Chi Q Nguyen
(74) *Attorney, Agent, or Firm* — Michael A. Mann; Nexsen Pruet, LLC

(57) ABSTRACT

A flush plug and a collar are used in installing a drain or cleanout. A flush plug is temporarily attached to the nipple of a cleanout or to a drain base and leveled. Concrete is then poured flush with the top of the flush plug. After the flush plug is removed from the cured concrete, a collar is installed in the hole in the concrete left by the flush plug. The outside of the lower portion of the collar is beveled like the flush plug. The upper portion of the collar includes a sleeve rising above the top surface of the surrounding concrete by an amount equal to the thickness of the specific floor finish. Tile or other finish may then be laid to around the collar. The installed drain will be flush and level with the flooring around it.

9 Claims, 4 Drawing Sheets

(56) References Cited

U.S. PATENT DOCUMENTS

| | | | | |
|---|---|---|---|---|
| 5,722,791 | A | 3/1998 | Dallmer | |
| 6,155,015 | A * | 12/2000 | Kirby | 52/302.1 |
| 6,273,124 | B1 * | 8/2001 | Huber et al. | 137/362 |
| 6,378,269 | B1 * | 4/2002 | Wiegand, Sr. | 52/745.05 |
| 6,687,925 | B2 * | 2/2004 | Minnick | 4/613 |
| 6,719,004 | B2 * | 4/2004 | Huber et al. | 137/362 |
| 6,755,966 | B1 * | 6/2004 | Reed | 210/164 |
| 7,699,981 | B2 | 4/2010 | Ledford et al. | |
| 7,735,512 | B1 * | 6/2010 | Ismert et al. | 137/362 |
| 7,964,095 | B1 * | 6/2011 | Graybeal | 210/164 |

* cited by examiner

METHOD AND SYSTEM FOR INSTALLING A DRAIN

PRIORITY CLAIM

Priority is claimed to U.S. provisional patent application Ser. No. 61/356,773 filed 21 Jun. 2010, which is incorporated herein in its entirety by reference.

BACKGROUND OF THE INVENTION

Drains and cleanouts are installed near the beginning of construction of a residence, business office or industrial facility, typically just before the concrete floors are poured. Construction may continue after that for months or several years. If the floor is finished with concrete, of course, the drain will be set flush with the top of the concrete pour. When the concrete is poured around drains in a floor that is to be finished using tile, the drain must sit above the top surface of the concrete by a sufficient margin to allow for the thickness of the tile and grout, adhesive or other securement so that, when the tile is installed around the drain, the top surface of the tile will be level with the top surface of the drain. The amount the drain sits up above the concrete prior to tile installation varies with the type of tile to be used, such as for example, ⅛" (3.175 mm) up from the surface of the concrete for VCT (vinyl composite tile); ½" (6.35 mm) up from the surface of the concrete for porcelain tile (⅛" grout plus ⅜" tile); 2" (51 mm) up from the surface of the concrete for ceramic tile (½" tile plus 1½" grout bed). Other floor finish materials may vary in thickness.

During construction, the drains and cleanouts are subject to abuse from the on-going construction work taking place around them, such as the impact of heavy objects and lateral forces caused, for example, by forklifts driving over them carrying pallets of blocks, steel, and other loads. Exposure to weather may cause drains to corrode, rust or tarnish. To provide some protection for drain covers, they may be covered with duct tape. Tape may provide protection from weather exposure but is little protection from abuse. After a while, tape tends to peel off, or it may be scraped off. At that point, water may wash concrete, dirt, and rocks into the drain.

Construction engineers will visit job sites regularly to inspect and note defects. Drains and cleanouts that are damaged or broken will be noted and their replacement demanded. Replacement requires breaking up the concrete around the drain, providing a new drain, and patching the concrete floor around the replacement drain. A damaged or broken drain can be expensive to fix, and the floor around it will be, and will look like, "a patch job."

Although the drains and cleanouts are installed near the beginning of construction, the area around the drain or cleanout is finished near the end of the process. At this point, all heavy construction has been completed and the building is protected from weather.

Concrete finishers use 10' (30.5 cm) to 15' (46 cm) screen boards to pull the concrete flat. When a drain sits up higher than the level of the concrete, the board must be picked up and moved over the drain. This requirement results in a rougher finish in the area immediately around the drain. When the concrete sets and becomes firm, a power screed machine is used to obtain a smooth finish. Because the drain sits higher than the concrete, the screed must be maneuvered around the drain. Finishers will then use a hand trowel to smooth the concrete around the drain, visually maintaining the clearance of the drain by a distance above the finished concrete sufficient for the thickness of grout and tile. If they leave too much concrete, the drain will not sit up high enough to match the tile's top surface, and the excess concrete will need to be removed by chiseling or grinding. If the finisher pulls too much concrete away, then the drain will sit too high and floor fill material will be spread around the drain to bring the concrete surface even with the tile top surface. Drains sitting lower or higher than the tile are a tripping hazard. Drains may not be level and be flush on one side but a little higher or lower on the opposing side. Whenever the drain and surrounding tile are not level, both appearance and safety are adversely affected.

SUMMARY OF THE INVENTION

The present invention overcomes the problems associated with the prior art by using a kit for installing a drain. The kit includes a flush plug and a collar as well as the drain base. The flush plug is a temporary cover that attaches to the threaded, adjustable nipple of a cleanout or to a threaded, adjustable drain base. The drain cover is stored safely during construction so it is not damaged or exposed to weather or wear. The flush plug is not set at the elevation of the drain but rather at the elevation to which the concrete is to be poured. Concrete is then poured flush with the top surface of the flush plug, making it much easier to obtain a smooth, even finish around the drain. Hand trowels and screeds can be worked over the flush plug and drain as if they were any other part of the concrete surface; they do not have to be avoided as in the case of the prior art drain cover. Moreover, the top surface of the flush plug indicates to the pourer of the concrete when the amount of concrete is sufficient because its top surface is at the right level for the pour. He just needs to stop pouring concrete when the concrete is flush with the top surface of the flush plug. Accordingly, the flush plug's top surface serves as a guide for that level.

When it is time for the finished floor to be installed, the flush plug is removed. The shape and design of the flush plug makes it easily removable. To facilitate removal of the flush plug from the surrounding, cured concrete, it is formed with a threaded hole in the center of the plug's top surface. The threaded hole is fitted with a plastic insert that sits even with the top surface of the flush plug during construction, and keeps out concrete and dirt. The insert can be popped out with a screwdriver or knife, revealing a ⅜" (9.5 mm) bolt screwed into the hole for use in lifting the flush plug from the surrounding poured concrete. In addition, the flush plug is tapered slightly (⅛" (0.32 mm)) from top to bottom so it can be easily removed from the cured concrete, leaving a tapered hole behind. The flush plug may also carry a bulls-eye bubble level to set a level drain.

After the flush plug is removed, the collar can be installed in the same, tapered hole in the concrete as was left by the flush plug. The outside of the lower portion of the collar is tapered exactly like the flush plug so it fits perfectly into the tapered hole left in the concrete by the flush plug and on top of the cleanout nipple or drain base below. The upper portion of the collar serves as a sleeve extension to raise the top surface of the collar above the surrounding concrete by the exact amount required for the specific floor finish specified for that floor.

The bottom of the collar may be sized to fit on the threaded adjustable nipple of the cleanout body or to fit on the rim of the drain base turning down into the drain base. The top portion of the collar is shaped to hold the drain top cover. The bottom of the collar sits on the drain base. The upper portion of the collar extends vertically above the concrete so that tile, when installed, can butt against the collar level with the collar's top surface. Screws are used to anchor the collar to the drain base. A small tube of silicone caulk seals the collar to the base. By applying a small bead of the silicone caulk to bottom of collar where it meets the base, and a small bead around the top of the beveled edge of collar where it meets the top surface of the concrete, the drain or cleanout will have a water-tight seal with the floor.

Before installing the collar, a user may vacuum dust and dirt from the drain base and concrete hole to ensure a proper fit and seal.

The flush plug assures a smooth, even concrete surface around drain for the collar, and the collar assures that the drain and cleanout tops are set level and to the proper height above the concrete so that they will be level with the top surface of the finished floor. Accordingly, the installed drain with its top cover in place will have a smooth, finished and professional appearance that sits level and flush with the surrounding floor. In addition to the better finished appearance, the present method and system saves money and time by reducing the likelihood that the drain will need to be repaired between the time the concrete is poured and the drain surrounds are finished at the conclusion of construction.

Flush plugs can be made to fit various drains and cleanouts, and collars can be made to correspond to any floor finish thickness. Cleanout and drain bases may be shipped with a flush plug installed on the base at the factory, ready to be set in concrete. Collars and top covers may be packaged and shipped separately so they can be ordered closer to the time when needed.

BRIEF DESCRIPTION OF THE DRAWINGS

In the figures.

DETAILED DESCRIPTION OF THE INVENTION

Figure 1A:
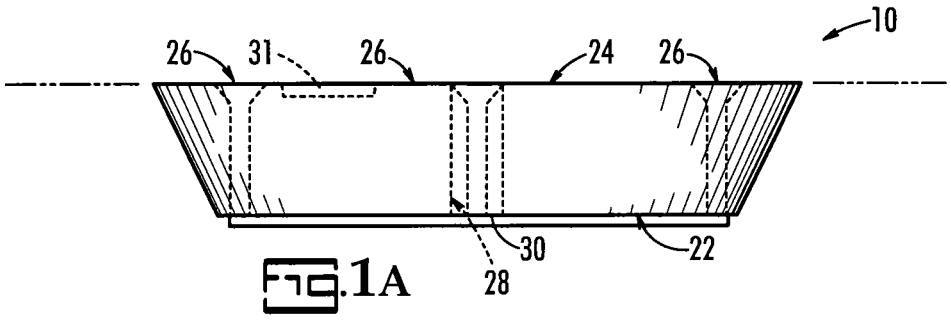
FIGS. 1A and 1B—side and top views of flush plug for a round floor drain or cleanout, according to an embodiment of the present invention.

The present invention is a method and system for installing a drain or cleanout. The word "drain" will be used herein to represent both a drain and a cleanout in order to simplify the description of the present invention that follows and in the claims that follow. The improvement of the present method begins after installation of a drain base for a drain and the installation of the adjustable nipple for a cleanout. The term "drain base" will be used herein for a drain base and for the adjustable nipple of a cleanout.

The present drain installation kit includes three major components (and may be provided as part of a larger kit that also contains the components for forming a drain base). The kit includes a tapered flush plug formed to be securable to the drain base. The flush plug has a top surface that is set at a first pre-selected height above the drain base by selecting the size flush plug needed to achieve that pre-selected height in order to match the level of concrete to be poured around the drain. The kit includes a tapered collar also formed to be securable to the drain base in place of the flush plug. The collar has a top edge and is also selected to be securable to the drain base so that its top edge is set above the drain base by a second pre-selected height in order to match the level of the flooring to be laid around the drain cover. Finally, the kit includes a drain top cover formed to be securable to the collar within its top edge. Of course, fasteners and sealant may also be provided to secure the flush plug and collar to the drain base and the top cover to the top collar as part of the present kit.

The flush plug may have a threaded hole formed therein for use in temporarily securing a handle, such as a bolt, to the plug. The hole may be fitted with an insert until the hole is needed for attaching the handle. The flush plug may also include a level indicator such as a bull's-eye level.

The present method involves several steps. Initially, a prior art drain base with a factory installed flush plug, is installed on the drain pipe so that the top surface of the flush plug is at a first pre-selected height above the drain base. Then a tapered flush plug is secured to the drain base using provide screws so that the top surface of the flush plug is brought to a first pre-selected height above the drain base. This first pre-selected height is the level to which the concrete floor around the drain should be poured. The top of the flush plug will thus serve as a guide for those pouring the concrete so that they do not pour too little or too much concrete. Furthermore, because the top surface of flush plug is flush with the poured concrete, finishing the concrete is simplified; the usual tools will ride over the top surface and do not have to go around it.

The flush plug should be checked with a level indicator to see that it is level after it and the drain base are fastened to the drain pipe. Concrete is then poured around the flush plug until it is level with or flush with the top surface of the tapered flush plug. After the concrete cures, the flush plug can be removed, leaving a tapered hole in the cured concrete. Because the flush plug was level, the vertical axis of the hole is also vertical.

Next, after vacuuming any dirt and debris out of the drain, a collar is placed on the drain base. The collar has a top edge and is then secured with, screws, such as collar anchor screws described below, to the drain base so that the top edge of the collar is at a second pre-selected height above the base. The difference between the first and second pre-selected heights is the thickness of the flooring to be installed on the concrete, bringing the surface of the floor with the installed flooring flush with the leveled drain.

The flooring is then laid on the concrete and the top cover is secured with screws within the top edge of the collar.

Figure 1B:
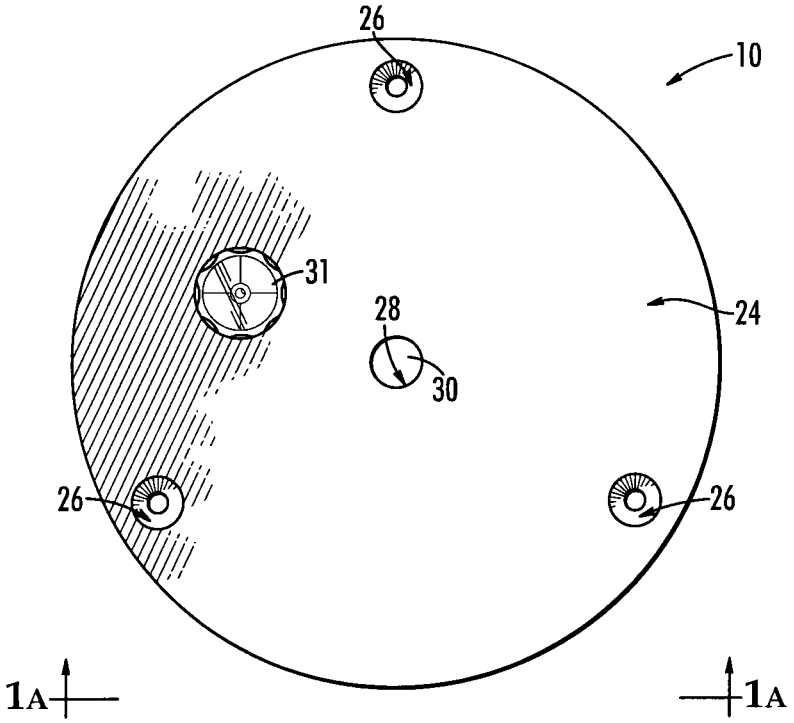

Referring now to FIGS. 1A and 1B, the present system includes a flush plug 10 that is used temporarily during construction to cover a prior art drain base (not shown) and which is inserted onto the drain base. After it is removed toward the end of construction, flush plug 10 may then be disposed of or reused elsewhere. Using flush plug 10 avoids the damage to the permanent drain that often occurs during construction. FIGS. 1A and 1B are side and top views of flush plug 10. Flush plug 10, as illustrated in FIGS. 1A and 1B, is circular and tapered from top to bottom so that the bottom 22 has a smaller diameter than top surface 24. Flush plug 10 is preferably made of plastic or nylon. It may have several holes about the periphery of top surface 24, such as three countersunk holes 26, for receiving anchoring screws (not shown) to secure flush plug 10 to the drain base (not shown) through corresponding holes in the drain base. It may also have a hole 28, such as a $\frac{3}{8}^{th}$ inch threaded hole, which may be formed in the center of top surface 24, with an insert 30 to temporarily cover hole 28. Flush plug 10 may have a bull's-eye bubble level 31 incorporated into it.

When flush plug 10 is to be removed, insert 30 is first pried off, perhaps with a screw driver or knife, then a $\frac{3}{8}^{th}$ inch bolt (not shown) is threaded into hole 28 to serve as a convenient, temporary handle used to lift flush plug 10 from the surrounding concrete. Flush plug 10 can be removed by pulling on the bolt.

Figure 2A:
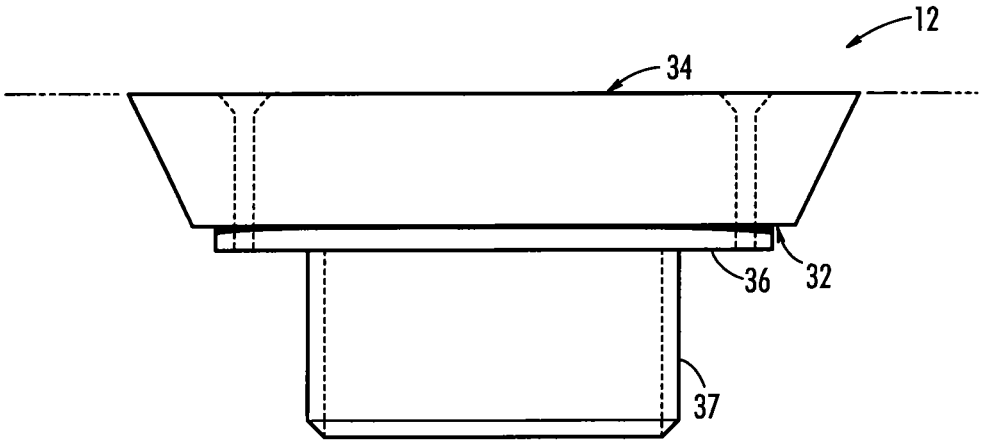
FIGS. 2A and 2B—side and top views of flush plug for square floor drain, according to another embodiment of the present invention.
Figure 2B:
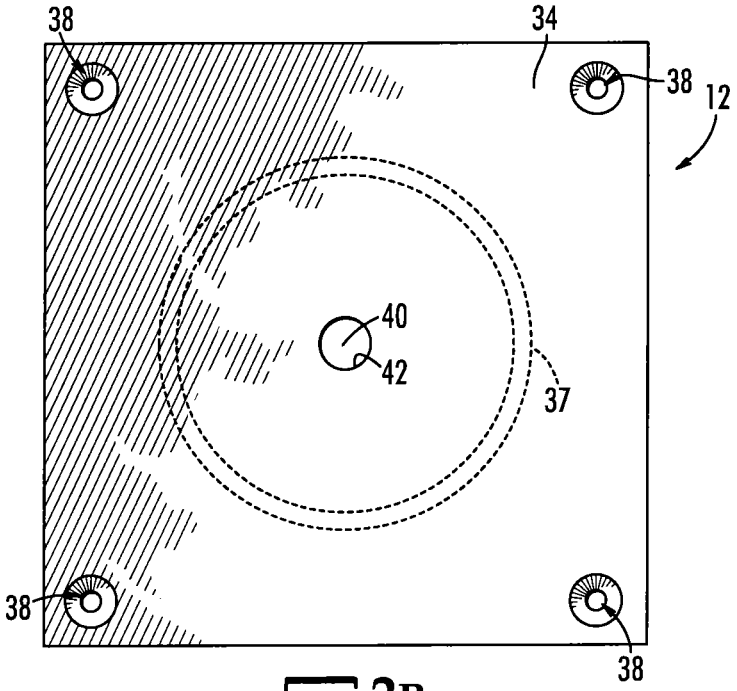

FIGS. 2A and 2B illustrate side and top views, respectively, of a square flush plug 12. Note the ledge 32 along the bottom edge of flush plug 12 where flush plug 12 will sit securely on a square drain base. Flush plug 12 has a top surface 34 and a bottom surface 36, with counter-sunk holes 38 for receiving screws to hold it to the drain base. Flush plug 12 has an insert 40 that fits into a threaded central hole 42. As with flush plug 10, insert 40 is removed to allow a bolt to be threaded to hole 42 of flush plug 12 to facilitate its removal from surrounding, cured concrete.

Different drains may have different shapes and sizes and hole patterns. Flush plugs may be shaped and sized and have hole patterns that correspond to the drain specified by the builder, except that each flush plug will have beveled sides so that, after the concrete is poured even with the top surface of flush plug and the concrete cures, the flush plug can be easily removed from the drain base, leaving behind a beveled and leveled hole in the surrounding concrete.

For large drains, that require a large flush plug, a support pipe 37 (see FIGS. 2A and 2B may be used to support to the center portion of flush plug 34 against the inside of the drain base. Support pipe may be section of polyvinyl chloride piping preferably set with its top within a circular recess formed in flush plug 37 and having a bottom beveled to engage the sloping part of drain base. Support pipe 37 is removed with flush plug 34 when the concrete poured around it has cured.

Figure 3A:
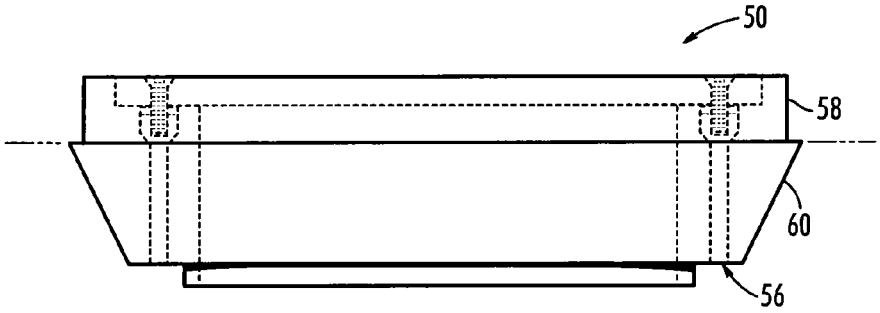
FIGS. 3A and 3B—side views of collar made to fit in a void in concrete left by a flush plug as illustrated in FIGS. 2A and 2B, respectively.
Figure 3B:
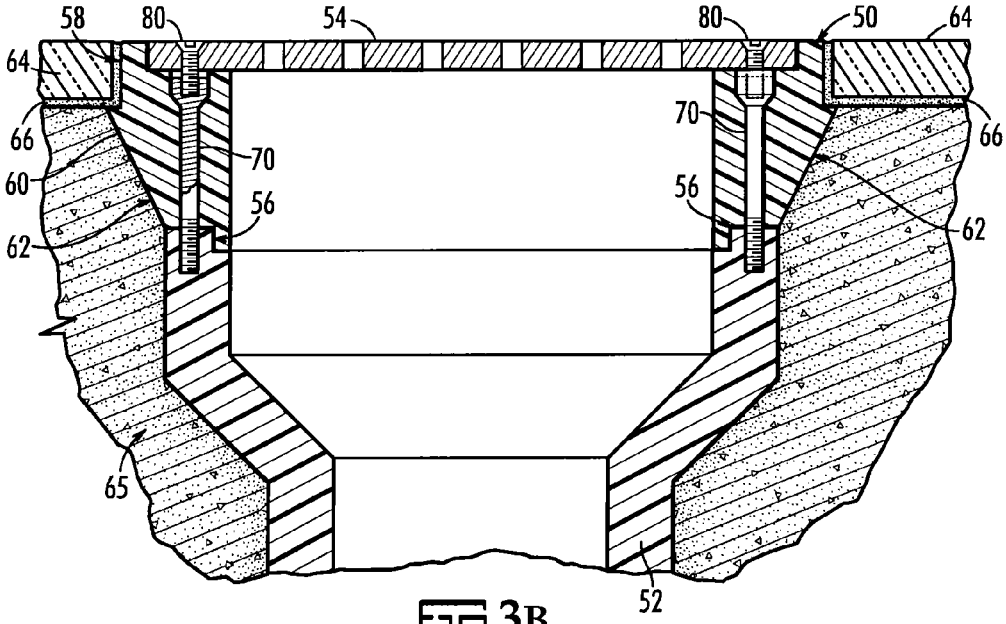

FIGS. 3A and 3B are a side view of a collar 50 and cross sectional views of collar 50 in place and when the area surrounding the drain is finished, respectively. FIG. 3A shows collar 50 that corresponds to square flush plug 12 illustrated in FIG. 2A from the side; FIG. 3B illustrates in cross-section collar 50 in place on a drain base 52 and with top drain cover 54 installed and fastened on collar 50 into collar anchor screw 55. Collar 50 has the same shape and size as the flush plug 12 including ledge 56 to correspond to ledge 32 as shown in FIG. 2A except for the addition of an upper, vertical top edge 58. The lower, beveled portion 60 of collar 50 fits into the hole 62 made in concrete 65 made by flush plug 12 for that drain. The top edge 58 extends above hole 62. Note that the height of top edge 58 of collar 50 is sized to equal the thickness of the adjacent tile 64 including its grout 66 so that the top surface of the top drain cover 54 and collar 50 are flush with the top surface of tile 64. So that the top surface of tile 64 is flush with the top surface of drain cover 54, the height of top surface 34 above drain base 52 is pre-selected to determine the top of concrete and the top edge 58 above drain base 52 is pre-selected to determine the top surface of tile 64. The difference is the thickness of tile 64 and the grout or adhesive that holds it to the concrete.

Figure 4A:
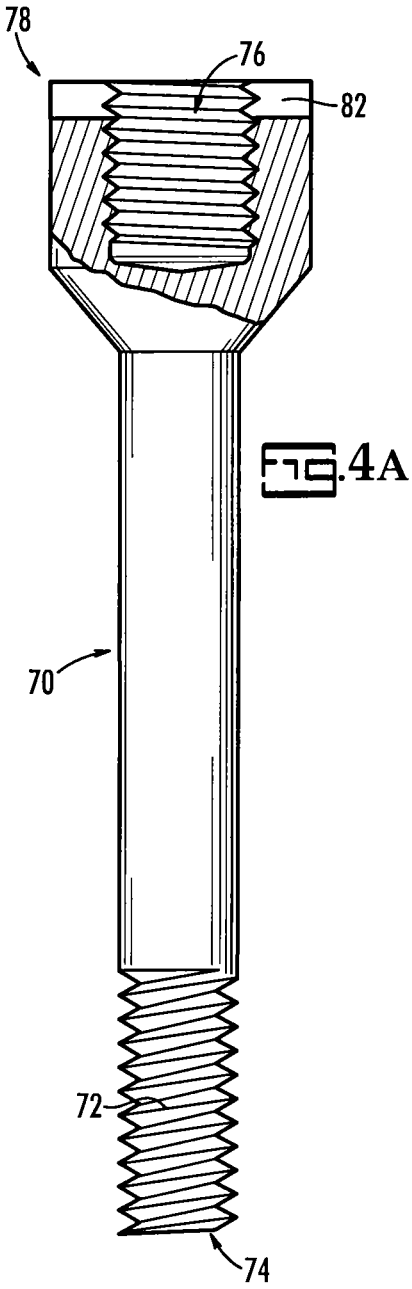
FIGS. 4A and 4B—side and top views, respectively, of a collar anchor screw, according to an embodiment of the present invention.
Figure 4B:
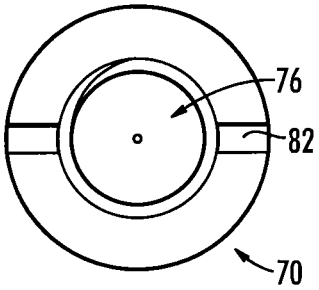

Referring now to FIGS. 3B, 4A and 4B, there is illustrated a collar anchor screw 70 that secures collar 62 to drain base 52 and enables top drain cover 54 to be secured to collar anchor screw 70. Anchor screw has external threads 72 at a lower end 74 and an internal threaded hole 76 at an opposing upper end 78 that is radially wider than lower end 74 so as to be able to receive a screw 80 to hold top cover drain to collar 62 (best seen in FIG. 3B). Anchor screw 70 has a transverse slot 82 formed in upper end 78 dimensioned to receive a flathead screw driver that can be used to turn anchor screw 78 and thereby screw lower end 74 into drain base 52. Holes dimensioned to receive anchor screw are pre-drilled into collar 62 and drain base 52.

With only straight-forward changes, the flush plug and collar can be adapted to accommodate a wide variety of shapes of pre-existing drains and cleanouts. Flush plugs can be made of PVC, ABS, nylon or high density plastic. Fiberglass and coated wood may also be used. Manufacturing cost and durability on materials determine the appropriate choice as well as whether the flush plug is to be re-used. Flush plugs that span larger drains may be supported by a section of pipe, such as polyvinyl chloride (PVC) pipe. The pipe is placed with its axis oriented vertically between the drain base and the bottom of the flush plug. A small annular groove cut in bottom of the flush plug keeps pipe centered and in place. Used flush plugs may be returned to manufacturer to be used again, if so desired.

Those skilled in the art of floor drains and cutouts and their installation will appreciate that many changes and modifications can be made in the foregoing embodiments without departing from the spirit and scope of the present invention, which is defined by the appended claims.

What is claimed is:

1. A method for installing a drain, comprising the steps of:
(a) providing a drain base;
(b) fastening a flush plug to said drain base, said flush plug having a top surface;
(c) pouring concrete around said flush plug until level with said top surface of the plug;
(d) after said concrete cures, removing the flush plug thereby leaving a hole in said cured concrete;
(e) securing a collar having a top edge to said drain base and through said hole in said cured concrete so that said top edge of said collar extends above said top surface of said flush plug by a pre-selected height;
(f) applying flooring to said cured concrete around said collar, said flooring having a thickness equal to said pre-defined height so that said top edge of said collar is flush with the top of said flooring; and
(g) securing a top cover to said collar.

2. The method as recited in claim 1, wherein said flush plug carries a level, and wherein said method further comprises the step of leveling said flush plug before said concrete is poured.

3. The method as recited in claim 1, wherein said flush plug has an insert covering a threaded hole in said flush plug, and wherein the removing step further comprises the steps of:
(a) removing said insert;
(b) threading a bolt to said threaded hole of said flush plug; and
(c) pulling said bolt to remove said flush plug.

4. A method for installing a drain, comprising the steps of:
(a) providing a drain base;
(b) fastening a flush plug to said drain base, said flush plug having a top surface;
(c) pouring concrete around said flush plug;
(d) after said concrete cures, removing said flush plug thereby leaving a hole in said cured concrete;
(e) securing a collar having a top edge to said drain base, in said hole in said cured concrete, with collar anchor screws;
(f) securing a top cover within said top edge of said collar; and
(g) applying flooring to said cured concrete around said collar; and further comprising the step of setting the height of said flush plug at a first pre-selected height with respect to said drain base to match the level of said concrete to be poured around said flush plug.

5. The method as recited in claim 4, further comprising the step of setting the height of said collar at a second pre-selected height with respect to said drain base to match the level of said flooring to be applied to said cured concrete.

6. The method as recited in claim 4, further comprising the step of leveling said flush plug.

7. The method as recited in claim 4, wherein said flush plug has a hole formed therein and an insert fitted into said hole, and further comprising the steps of:

(a) removing said insert after said concrete has cured; and (b) attaching a handle to said flush plug through said hole.

8. A method for installing a drain, comprising the steps of:

(a) providing a drain base with a tapered flush plug attached thereto, said tapered flush plug having a top surface, said top surface being set at a first pre-selected height above said drain base;

(b) leveling said tapered flush plug and drain base;

(c) pouring concrete around said flush plug until said concrete is level with said top surface of said tapered flush plug;

(d) after said concrete cures, removing said tapered flush plug thereby leaving a tapered hole in said cured concrete;

(e) placing a collar on said drain base, said collar having a top edge;

(f) setting said collar vertically so that said top edge is set at second pre-selected height above said drain base;

(g) securing said collar to said drain base, through said tapered hole in said cured concrete, so that said top edge of said collar extends above said drain base by said second pre-selected height;

(h) applying flooring to said cured concrete around said collar, said flooring having a thickness equal to the difference between said second pre-selected height and said first pre-selected height so that said top edge of said collar is flush with said floor; and (i) securing a top cover within said top edge of said collar.

9. The method as recited in claim 8, further comprising the step of sealing said collar to said drain base.

* * * * *